US006488023B2

(12) United States Patent
Pecoskie

(10) Patent No.: US 6,488,023 B2
(45) Date of Patent: Dec. 3, 2002

(54) PORTABLE STOVE FOR USE WITH A CONTAINER CONTAINING FUEL

(76) Inventor: Phil Pecoskie, 1643 Hillside Dr., London, Ontario (CA), N6G 2N3

( * ) Notice: Subject to any disclaimer, the term of this patent is extended or adjusted under 35 U.S.C. 154(b) by 0 days.

(21) Appl. No.: 09/820,240

(22) Filed: Mar. 28, 2001

(65) Prior Publication Data

US 2001/0035178 A1 Nov. 1, 2001

(30) Foreign Application Priority Data

Apr. 6, 2000 (CA) ..... 2303347

(51) Int. Cl.[7] ..... F24C 5/02
(52) U.S. Cl. ..... 126/43; 126/44; 126/50
(58) Field of Search ..... 126/43, 44, 50, 126/45, 46, 47, 48, 49, 38, 29, 25 R, 248, 252, 258, 260, 256; 431/203, 320, 321, 324, 344

(56) References Cited

U.S. PATENT DOCUMENTS 452,897 A * 5/1891 Duryea ..... 126/258
936,482 A * 10/1909 Sheeley ..... 126/29
1,049,416 A * 1/1913 Snider ..... 126/258
1,210,099 A * 12/1916 Pohl ..... 126/43
1,437,073 A * 11/1922 Popper ..... 126/43
2,088,797 A * 8/1937 Larsen ..... 126/43
2,335,020 A * 11/1943 Nehrich ..... 126/43
2,877,759 A * 3/1959 Giese ..... 126/215
3,140,740 A * 7/1964 Lagreid et al. ..... 126/44
3,371,659 A * 3/1968 Paspalas ..... 126/43
3,381,678 A * 5/1968 Fry ..... 126/4
3,566,857 A * 3/1971 Price ..... 126/262
4,134,385 A * 1/1979 Barter ..... 29/892.3
4,604,053 A * 8/1986 de la Rosa ..... 126/45
4,905,659 A * 3/1990 Armistead ..... 126/25 A
5,012,791 A * 5/1991 McCabe ..... 126/214 D
5,163,415 A * 11/1992 Moncrief et al. ..... 126/43
5,284,126 A * 2/1994 Varney ..... 126/29
5,307,789 A * 5/1994 Newby ..... 126/25 A
5,307,799 A * 5/1994 Scarnato et al. ..... 126/43
5,592,871 A * 1/1997 Bartlett ..... 126/273.5
5,881,709 A * 3/1999 Daoust ..... 126/38
6,314,955 B1 * 11/2001 Boetcker ..... 126/25 R

* cited by examiner

*Primary Examiner*—Henry Bennett
*Assistant Examiner*—Kathryn Ferko
(74) *Attorney, Agent, or Firm*—Eric Fincham

(57) ABSTRACT

There is provided a stand for a canned heat fuel cell wherein the stand has a side wall, an upper marginal edge and a lower marginal edge, the side wall being sized to be slightly larger than the fuel cell side wall, inwardly extending groove dividing the side wall into upper and lower portions with the upper portion having a height greater than the lower portion and also having a plurality of apertures to permit an air supply therethrough, grill bars for sheeting on the top of the side wall, the arrangement being such that the stand will sit on the upper marginal edge of the canned heat fuel cell. The arrangement provides an efficient means of using the fuel cell while preventing bums to the user and/or damage to the substrate surface.

6 Claims, 2 Drawing Sheets

PORTABLE STOVE FOR USE WITH A CONTAINER CONTAINING FUEL

FIELD OF THE INVENTION

The present invention relates to a stand for a heating device and more particularly relates to a stand for a heating device which can hold a canned heat fuel cell in a secure and stable position.

BACKGROUND OF THE INVENTION

The use of containers of fuel for heating food or other products is well known in the art. Generally, there have been two different types of devices which have gained popularity. The first one is an alcohol fuel burner wherein there is provided a container having a material therein for use as a burner and which container is designed to receive alcohol. These devices are widely used in the home for heating fondue types of foods.

A second type of device is one wherein a canned fuel cell is employed. Generally, the canned fuel cells have a solid fuel therein which is designed to burn and produce heat. These devices are widely used as cooking stoves particularly when camping.

SUMMARY OF THE INVENTION

It is an object of the present invention to provide a stand which may used in conjunction with a canned heat fuel cell and which stand is designed to accommodate cooking utensils such as pots and pans.

It is a further object of the present invention to provide a stand for a canned heat fuel cell which is simple, and which may be easily stored when not in use.

It is a further object of the present invention to provide a portable stove for use with a canned heat fuel cell which may be used in inclement conditions and wherein its use as a source of heat and light is maximized while minimizing the possibility of injury to a user.

According to one aspect of the present invention, there is provided, in combination, a cylindrical fuel container containing fuel for generating heat and a stand, the stand comprising a cylindrical side wall having an upper marginal edge and a lower marginal edge, an inwardly extending groove dividing the cylindrical side wall into an upper cylindrical side wall portion and a lower cylindrical side wall portion, a plurality of apertures in the upper cylindrical side wall portion, and first and second grill bars, each of the grill bars being of a generally rectangular configuration, a first one of the grill bars having two slots formed therein to receive the upper marginal edge, a second one of the grill bars having three slots formed therein to receive the upper marginal edge and the first one of the grill bars, the fuel container having an upper marginal edge, the stand being sized such that the inwardly extending groove seats on the upper marginal edge of the fuel container, and wherein the upper cylindrical side wall portion has a height substantially equal to a height of the cylindrical fuel container.

The fact that the upper cylindrical side wall portion has a height substantially equal to the height of the cylindrical fuel container permits the cylindrical fuel container to be stored within the stand when not in use. This permits safe shipping and storage. In other words, the stand provides eta protection for the container.

Preferably, the upper cylindrical side wall portion has a height between 2 and 3 times the height of the lower cylindrical side wall portion. This provides for maximum ventilation and is also designed to allow for protection of a cap member which is conventionally used in such fuel containers.

In greater detail, the stand of the present invention allows for use of a canned heat fuel cell of a certain size so as to permit one to use the fuel cell in a stabilized position as a source of heat and light. In particular, when used with the two grill bars, one can cook with the heat from the fuel cell. The stand is being designed such that when used in clement conditions, the stand functions as a wind screen. When not is use, the canned heat fuel cell may be stored within side the stand to minimize storage space and provide a protection therefore. The device is designed to minimize injury from one being burned or cut from any side edges. Preferably, the material used in the cylindrical side wall is of a metallic material which has been treated to prevent corrosion thereon.

The two grill bars contain notches or slots to permit the interlocking of the grill bars and to accommodate the upper marginal edge or rim of the cylindrical side wall.

The grill bars provide stability to the device by providing more surface area to rest on.

The placing of the stand on the top of the fuel cell and the provision of the apertures on the upper cylindrical side wall portion eliminate heat transfer to the surface area when the heat fuel cell is lit. The device provides an insulating function and there is little heat transfer from the side wall of the heat fuel cell to the outer side wall of the stand. While lit and inside the device, the fuel cell can be easily placed on any flat surface area and one may thus eliminate any concern of transferring heat beneath or to the side walls of the device which can cause burns or other damage to the top side of the surface area.

Preferably, the apertures in the side wall each have an area of between 15 $mm^2$ and 25 $mm^2$ Preferably, there are seven such apertures although it will be understood that any number consistent with the proper functioning of the device may be employed, this also being a function of the area of the apertures.

Preferably, the lower cylindrical side wall portion has a plurality of dimples formed therein. These dimples are sized to substantially abut the side wall of the canned heat fuel cell and this will thus stabilize the device when placed on top of the canned heat fuel cell and substantially eliminate any tendency to rock due to variances which may be found in canned heat fuel cell rim circumferences. In a preferred embodiment, two such dimples spaced less than 180° apart are provided.

The grill bars are placed on top of the cylindrical side wall and are thus locked in place with the upper marginal edge of the side wall. As aforementioned, the grill bars provide a wide stable surface area for cooking and also reduce heat transfer from the cooking utensil to the cylindrical side wall of the stand. Thus, the cooking utensil may sit on top of the grill bars rather than directly on top of the cylindrical side wall. This eliminates the side wall from becoming too hot which can cause discoloration and even cause the metal to lose its protective coating and thus be subject to corrosion. Furthermore, this arrangement prevents the user from the danger of bums.

When inverted, the device is able to slide over the top of the canned heat fuel cell. This provides a compact storage arrangement and also provides protection for both the device and the canned heat fuel cell from being crushed or damaged.

The stand, as will be understood from the above, is configured to have a shape slightly larger than, and corresponding to the shape of the fuel cell. Conventionally, such shapes have been cylindrical although other configurations can likewise be used.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
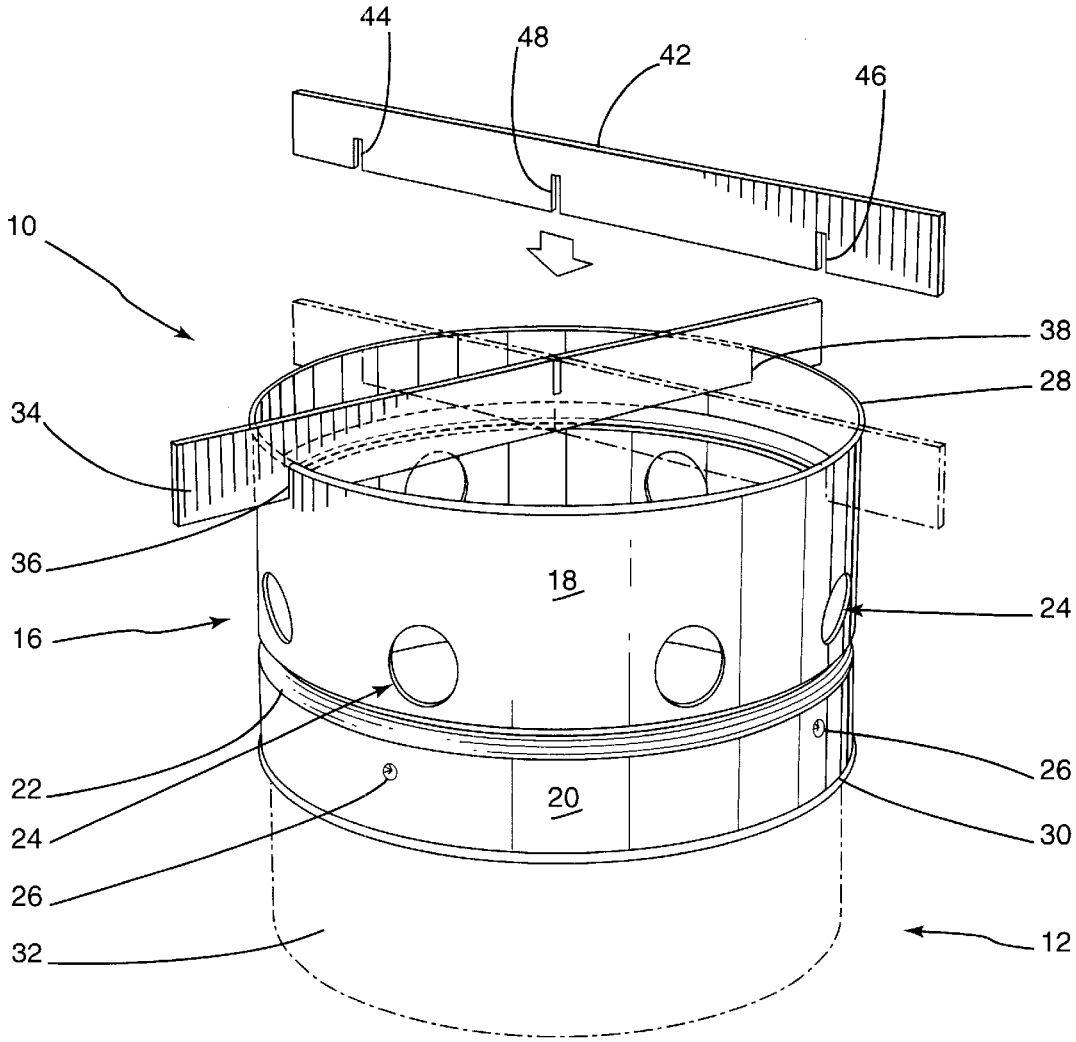
FIG. 1 is a perspective view of a portable stove and fuel cell according to the present invention.
Figure 2:
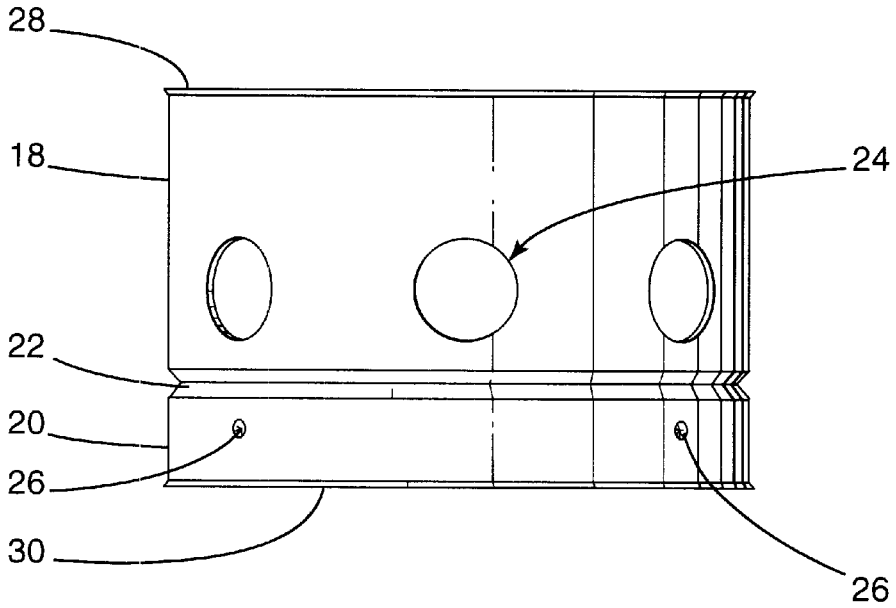
FIG. 2 is a side elevational view of a portion of the stove of FIG. 1.
Figure 3:
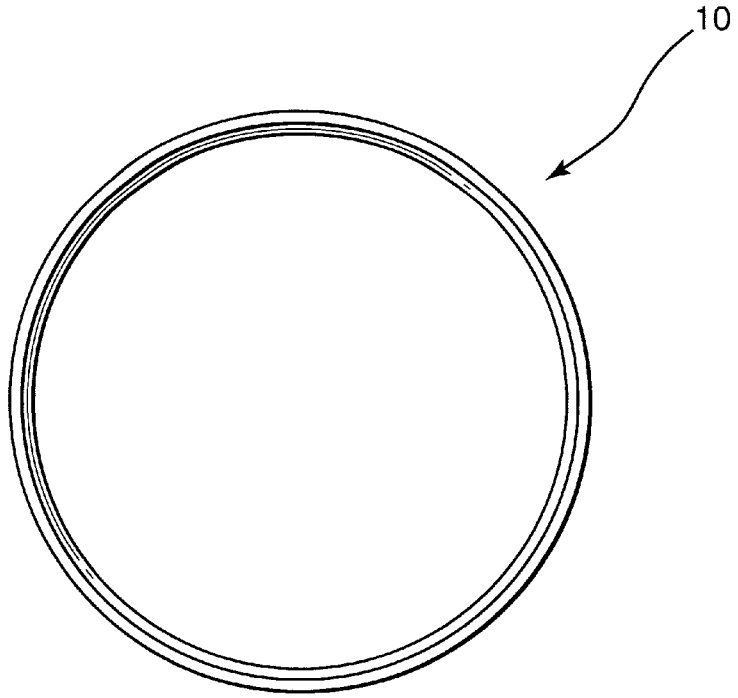
FIG. 3 is a top plan view thereof.

Referring to the drawings in greater detail and by reference characters thereto, there is shown in FIG. 1 a stove which is generally designated by reference numeral 10 and a canned fuel cell generally designated by reference numeral 12.

Stove 10 has an overall cylindrical configuration and has a cylindrical side wall generally designated by reference numeral 16. An inwardly extending groove 22 divides cylindrical side wall 16 into an upper cylindrical side wall portion 18 and a lower cylindrical side wall portion 20.

Formed in upper cylindrical side wall portion 18 are a plurality of apertures 24—seven being formed in the embodiment illustrated. In a lower cylindrical side wall portion 20, there are provided a pair of dimples 26 which extend inwardly.

At its upper marginal edge, cylindrical side wall 16 is provided with a rolled upper rim 28 while at its lower marginal edge, there is a rolled lower rim 30.

As shown in FIG. 1, fuel cell 12 has a fuel cell side wall 32 of a cylindrical configuration.

The first grill bar 34 is shown as having a generally rectangular configuration and includes slots 36 and 38 proximate the ends thereof and which slots 36 and 38 are sized to fit over rolled upper rim 28. Similarly, a second grill bar 42 has slots 44 and 46 at ends thereof to fit over rolled upper rim 28. Second grill bar 42 also has an intermediate slot 48 sized to fit over first grill bar 34.

And thus, as may be seen in FIG. 1, side wall 16 is placed such that groove 22 rests on the upper marginal edge of canned fuel cell 12. Apertures 24 permit an air supply to the fuel cell 12 while dimples 26 are designed to substantially abut the side wall of fuel cell 12 and prevent rocking.

When the stove is not in use, the stove is inverted and thus will fit completely over fuel cell 12 and provide a compact storage while protecting both the stove and the fuel cell.

It will be understood that above described embodiment is for purposes of illustration only and changes or modifications may be made thereto without departing from the spirit and scope of the invention.

I claim:

1. In combination, a cylindrical fuel container containing fuel for generating heat, and a stand, the stand comprising a cylindrical side wall having an upper marginal edge and a lower marginal edge, an inwardly extending groove dividing said cylindrical side wall into an upper cylindrical side wall portion and a lower cylindrical side wall portion, a plurality of apertures in said upper cylindrical side wall portion, and first and second grill bars, each of said grill bars being of a generally rectangular configuration, a first one of said grill bars having two slots formed therein to receive said upper marginal edge, a second one of said grill bars having three slots formed therein to receive said upper marginal edge and said first one of said grill bars, said fuel container having an upper marginal edge, said stand being sized such that said inwardly extending groove seats on said upper marginal edge of said fuel container, and wherein said upper cylindrical side wall portion has a height substantially equal to a height of said cylindrical fuel container.

2. The combination of claim 1 further including a plurality of inwardly extending dimples in said lower cylindrical side wall portion, said dimples extending inwardly a distance to substantially abut said cylindrical fuel container.

3. The combination of claim 2 wherein there are seven apertures formed in said upper cylindrical side wall portion.

4. The stand of claim 1 wherein said upper cylindrical side wall portion has a height between two and three times the height of said lower cylindrical side wall portion.

5. The stand of claim 1 wherein said apertures formed in said upper cylindrical side wall portion have a generally cylindrical configuration, each of said apertures having an area between 15 $mm^2$ and 25 $mm^2$.

6. The stand of claim 1 wherein said lower cylindrical side wall portion has two inwardly extending dimples, said dimples being spaced apart by less than 180°.

* * * * *